United States Patent [19]

Hashimoto et al.

[11] Patent Number: 4,613,985

[45] Date of Patent: Sep. 23, 1986

[54] SPEECH SYNTHESIZER WITH FUNCTION OF DEVELOPING MELODIES

[75] Inventors: Shintaro Hashimoto, Ikoma; Hideo Yoshida, Kashihara, both of

[73] Assignee: Sharp Kabushiki Kaisha, Osaka, Japan

[21] Appl. No.: 218,753

[22] Filed: Dec. 22, 1980

[30] Foreign Application Priority Data

Dec. 28, 1979 [JP] Japan ..... 54-171550

[51] Int. Cl.[4] ..... G10L 5/00

[52] U.S. Cl. ..... 381/51; 84/1.01

[58] Field of Search ..... 179/1 SM, 1 SG, 1 B; 84/1.01, 1.02, 1.24; 364/513, 513.5

[56] References Cited

U.S. PATENT DOCUMENTS 4,211,892 7/1980 Tanimoto et al. ..... 179/1 SM 4,213,366 7/1980 Niimi et al. ..... 84/1.01

OTHER PUBLICATIONS

Chapman, "Prospectives in Voice Response from Computers", Proc. Int'l Conf. on Comm's, 1970.

*Primary Examiner*—E. S. Matt Kemeny

*Attorney, Agent, or Firm*—Birch, Stewart, Kolasch & Birch

[57] ABSTRACT

A synthesizer is disclosed which has the function of generating synthesized human voices and melodies in the form of synthesized sounds. The speech synthesizer may be implemented with one or more LSI devices which include a central processor unit for receiving word codes or melody program codes and for controlling the synthesizer, a memory for storing the sequence of synthesis for each word and melody, a synthesized word generator for providing audible indications of the respective words in the form of a synthesized sound and a melody generator for providing melodies in the form of a synthesized sound. A decision circuit decides if word codes or melody programs are provided. The selected words are audibly delivered by fetching its associated sequence of synthesis from the memory and synthesizing those words through the synthesized word generator or the selected melodies are audibly delivered by fetching its associated sequence of synthesis from the memory and synthesizing the selected melodies through the melody generator.

6 Claims, 6 Drawing Figures

SPEECH SYNTHESIZER WITH FUNCTION OF DEVELOPING MELODIES

BACKGROUND OF THE INVENTION

This invention relates to a speech synthesizer also capable of developing desired melodies.

Melodies and combinations of melodies and synthesized voices expressing words are useful in a variety of commercial equipment.

OBJECTS AND SUMMARY OF THE INVENTION

Accordingly, it is an object of the present invention to provide a speech synthesizer which develops selectively a desired synthesized word or a desired melody by merely specifying a sound output instruction code (word codes or melody program code).

In one preferred form of the present invention, there is provided a speech synthesizer comprising central processor means for receiving word codes or melody program codes and controlling the speech synthesizer, memory means for storing the sequence of synthesis for each words and each melody, synthesized word generator means for providing audible indications of the respective words in the form of a synthesized sound and melody generator means for providing melodies in the form of a synthesized sound. One or more of the words are audibly delivered by fetching its associated sequence of synthesis from said memory means in response to receipt of its associated word code and synthesizing the word or words through said synthesized word generator means. One or more of the melodies ae audibly delivered by fetching its associated sequence of synthesis from said memory means and synthesizing the melody or melodies through said melody generator means.

BRIEF DESCRIPTION OF THE DRAWINGS

For a more complete understanding of the present invention and for further objects and advantages thereof, reference is now made to the following description taken in conjunction with the accompanying drawings, in which.

DETAILED DESCRIPTION OF THE INVENTION

Figure 1:
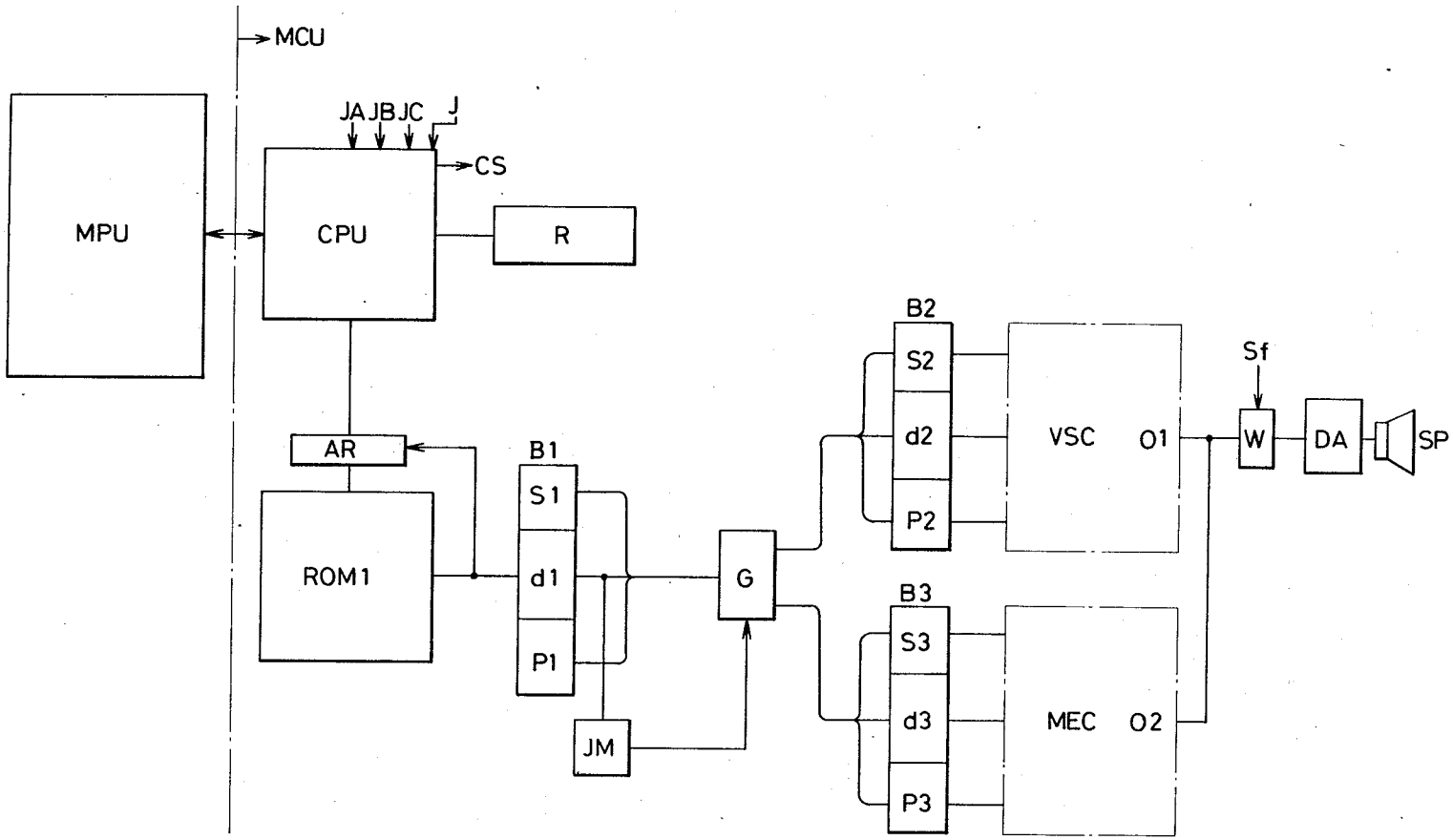
FIG. 1 is a block diagram of an embodiment of the present invention.

FIG. 1 is a block diagram of an embodiment of the present invention which includes a main control MPU and a speech synthesizer control MCU with the former executing major functions of a utilization device such as a timepiece or a calculator and also providing for the latter desired codes necessary for the delivery of synthesized words or synthesized melodies. Those codes are assigned to each of words in the case of a plurality of the synthesized words and to each of the melody programs in the case of the synthesized melodies. A central processor unit CPU accepts the above-mentioned codes and provides various other controls in response thereto. A storage memory ROM1 (typically, a read only memory) is adapted to previously store the sequence of synthesis for each of the words and each of the melodies. There is further provided a synthesized word generator VSC and a synthesized melody generator MEC.

It is well known in the art that synthesis of speech involves storing sequences of synthesis and a number of pieces of basic word information for synthesizing particular sounds associated with a selected word code. The term "word" used herein is intended to encompass words, sentences and any human sounds. It is possible to provide melodies by means of simple sounds. However, even though melodies are simple per se, synthesis of its sounds (pitches) demands a large number of pieces of information like that of human voices. If the synthesized word generator VSC is required to store numerous pieces of phonemic information necessary for synthesis of the melodies, such information would occupy a considerable area of the memory and reduce the storage area for vocaburary including words and sentences. In such case all that waved be possible is to provide very simple words by means of synthesized sounds. In the present invention, the synthesized word generator VSC and the synthesized melody generator MEC are independent of each other for their special purposes. The sequence of synthesis may be stored for each of the words and for each of the melodies in the same memory ROM1.

A memory R stores codes and various conditions inputted from the main control MPU. The above-mentioned memory ROM1 has an address circuit AR and an output buffer $B_1$. The contents of "d1" are introduced into a decision circuit JM which decides whether information specified by the main control MPU through the processor CPU is concerned with a word or a melody. This decision may be achieved by sensing a particular code combination peculiar to the word or the melody or a special distinguishing code. An output selection gate G is connected to input buffers $B_2$ and $B_3$ provided respectively for the synthesized word generator VSC and the synthesized melody generator MEC. Depending on the output of the decision circuit JM, one of the outputs of the gate G is selected to lead word information to the input buffer $B_2$ and melody information to the input buffer $B_3$. "$s_2$" in the buffer $B_2$ contains amplitude data, "$d_2$"contains phonemic information (basic sound information) specifying data and "$p_2$" contains pitch controlling data. On the other hand, "$s_3$" in the buffer $B_3$ contains amplitude daa, "$d_3$" contains pitch data and "$P_3$" contains duration data.

An output buffer W which is common to the synthesized word generator VSC and the synthesized melody generator MEC is sampled at a proper frequency signal Sf. A digital-to-analog converter DA converts sampled digital signals into analog signals which are released in the form of an audible sound via a loudspeaker S. It is noted that the output buffer W, the digital-to-analog converter DA and the loudspeaker S are used commonly to the delivery of synthesized words and synthesized melodies.

Figure 2:
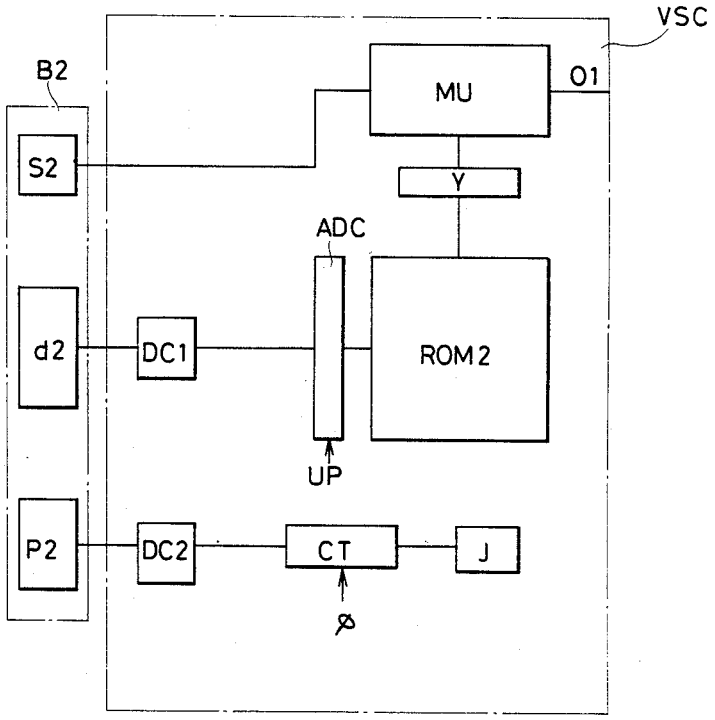
FIG. 2 is a block diagram of details of the synthesized word generator VSC of FIG. 1.

FIG. 2 is a block diagram detailing the synthesized word generator VSC of FIG. 1. A memory ROM2 stores a number of pieces of the phonemic information (basic sound unit information). The phonemic information specifying data $d_2$ are introduced into the buffer $B_2$ and decoded to properly address ROM2 via a decoder $DC_1$, thus establishing a desirable initial address via the address circuit ADC. The address contents are transferred into a register Y. Thereafter, the address circuit ADC is automatically incremented in response to application of an increment signal up, sequentially addressing the memory regions containing the plurality of pieces of phonemic information and furnishing the corresponding information of the register Y. An output level converter MU accumulates the amplitude data $s_2$ and the contents of the register Y and supplies the result thereof as phoneme synthesizing signals $o_1$. The pitch controlling data $p_2$ are decoded via the decoder $DC_2$ and fed into a counter CT which is decremented whenever a timing signal $\phi$ is applied. A decision circuit J decides if the count of the counter CT is "0" and feeds the result thereof to the central processor unit CPU. The pitch controlling data $p_2$ eventually determine the interval of the phoneme synthesizing signals $o_1$.

While the sequence of synthesis is fetched sequentially and repeatedly for each of the words in the above-mentioned manner, its associated words are audibly delivered via the loudspeaker SP. The speech synthesizer is thus ready for the introduction of a new word code or a new melody program code may be introduced.

Figure 3:
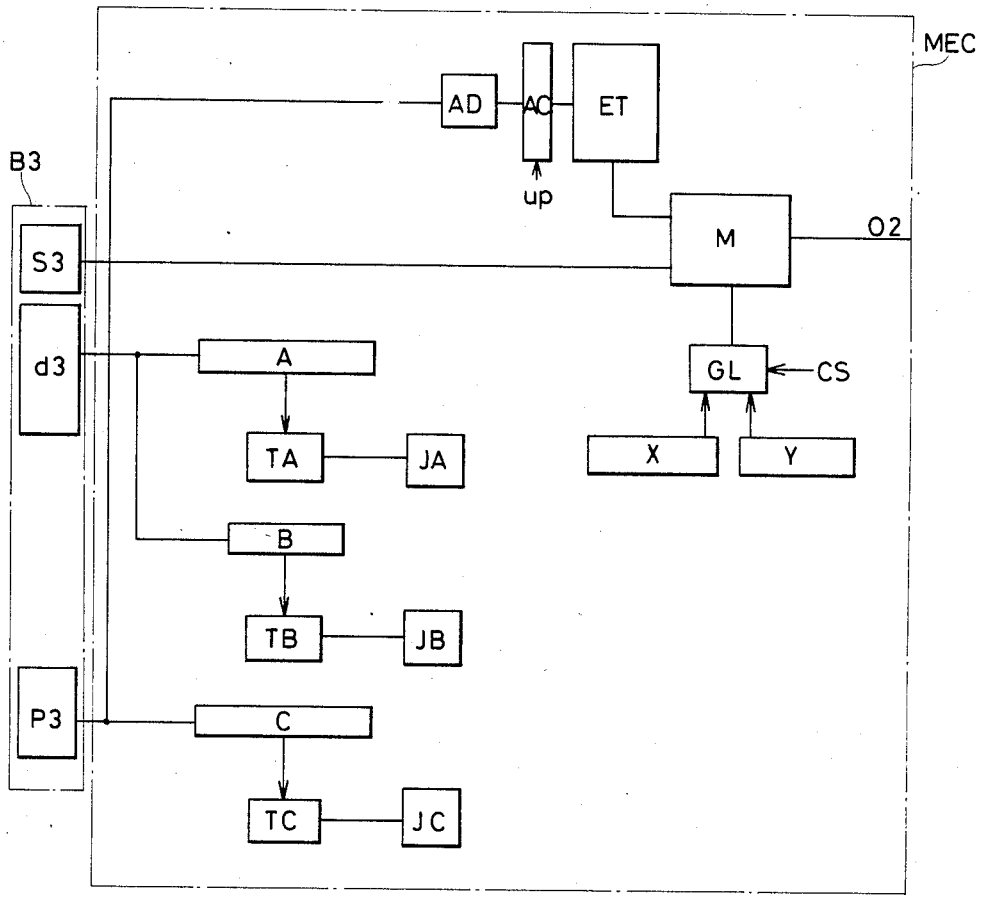
FIG. 3 is a block diagram of details of the melody generator MEC of FIG. 1.
Figure 4:
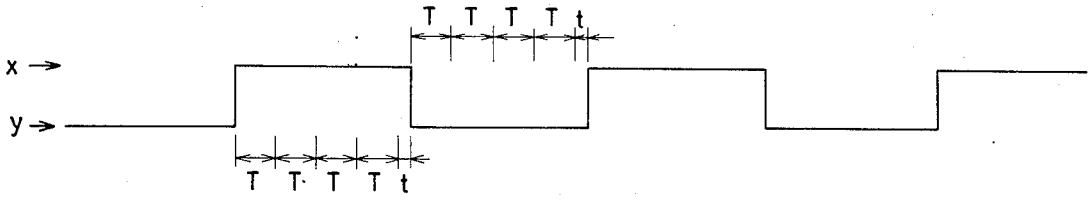
FIGS. 4 through 6 are time charts for explanation of operation of the embodiment of FIG. 3.

Upon application of the program code the melody synthesizer operates in the following manner. FIG. 3 is a block diagram showing details of the melody generator MEC of FIG. 1. The melody generator MEC develops digital pitch signals $o_2$ of a rectangular waveform as indicated in FIG. 4. The magnitude of the rectangular waveform is indicative of pitch and determined by the pitch data $d_3$ introduced into the buffer $B_3$. The period of the rectangular waveform is defined by an integral multiple of a fixed time T and a residual time t with information indicative of these factors being applied to registers A and B. Assuming T is 8 usec, the period of the waveform of FIG. 4 is 32 usec plus t wherein t is an integral multiple of a value $t_1$ which may be, for example, 1 usec. T is thus 8 times $t_1$. The register A is 5 bits long and the register B is 3 bits long.

A counter TA is decremented each fixed time T beginning with the contents of the register A as its initial value. A decision circuit JA decides if the count of the counter TA decreases to "0". Another counter TB is similarly decremented each fixed time $t_1$ begining with the contents of the register B as its initial value. A decision circuit JB decides if the counter TB assumes "0". Those decision results are supplied to the central processor unit CPU which, after the decision circuit JA provides the affirmative answer, actuates the counter TB, restarts the decrementing operations of the counters A and B and provides a signal CS each time the counters are decremented by one. A pair of registers X and Y previously stores values indicative of two-level values x and y on the enabling waveform as seen in FIG. 4. The contents of the registers x and y are selectively supplied to an output level converter M via an input selection gate GL enabled with the signal CS.

Figure 5:
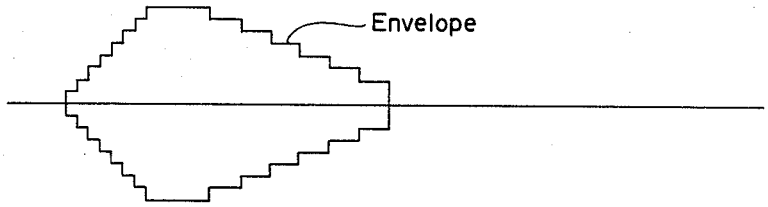

The output level converter M accumulates the inputs intoduced via the input selection gate GL, $s_3$ and ET to be described below and provides the result thereof as the digital pitch signals $o_2$. "$s_3$" in the buffer $B_3$ stores amplitude data which specify the amplitude of a selected musical note or pitch. The memory ET is provided to previously store envelope information in order to give the respective musical note signals as in FIG. 5 a proper envelope. The duration data $p_3$ are fed to an address decoder AD to specify a desired initial address in the memory ET via the address circuit AC. Then, desired regions of the memory ET are automatically accessed by the increment signal UP, thus sequentially providing pieces of the envelope information and varying the amplitude of a waveform concerning duration according to the duration data $p_3$.

Figure 6:
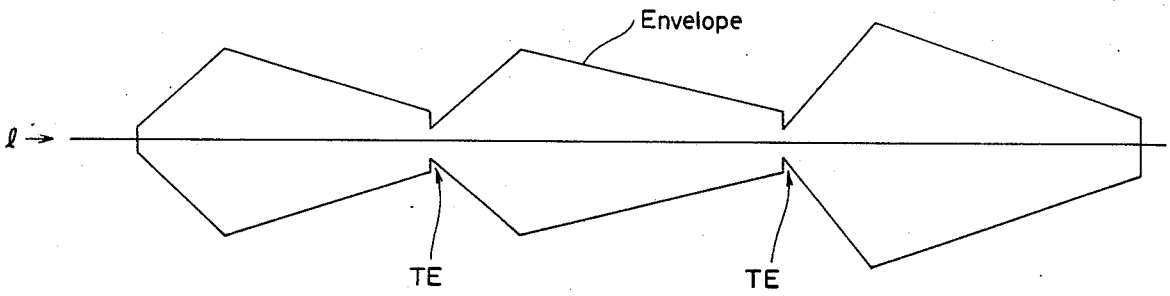

A register C stores the duration data $p_3$ and a counter TC decrements begining with the contents of the register C as its initial count. A decision circuit JC decides if the count of the counter TC reaches "zero" and provides information regarding the count thereof for the central processor unit CPU. If the count is "zero", then the address in memory ROM1 is incremented by one to transfer the next succeeding pitch data into the buffer $B_3$. Thus the pitch data is sequentially fetched in response to the selected one of the music programs, generating a sequence of melodic tones, as represented in FIG. 6. It is very convenient if the synthesizer is shut down before the trailing edge of the envelope converges in order that there is no silent interval between two pitches as seen at TE FIG. 6 to thereby provide more agreeable sound.

The registers A, B and C are shown as discrete memories in the embodiment of FIG. 3 for the sake of illustration only. It is obvious that they may be incorporated into specific regions of the memory R of FIG. 1. Furthermore, it is clear that so-called constant values to be stored in the registers X and Y, the envelope memory ET, etc., may be loaded into the memory ROM1 of FIG. 1. It is also possible that all of the electronic components in the speech synthesizer control MCU may be implemented with a one-chip LSI device to provide simplicity of manipulation and wiring in combination with the main control MPU.

Accordingly, the present invention provides synthesized sounds indicative of words in response to receipt of word output instruction codes introduced from an associated device as well as providing a selected melody in the form of synthesized sounds in response to introduction of melody program codes, thus providing, a versatile synthesizer applicable to many fields. Moreover, the main control in the utilization device uses conventional outputs as the word output instruction codes, demanding no particular modification and allowing flexibility of circuit design.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A synthesizer comprising:

central processor means for receiving word codes or melody program codes and for outputting signals controlling said synthesizer;

memory means for storing data representing sequences of sound synthesis for each of a plurality of words and melodies which may be synthesized by said synthesizer;

word generator means for providing audible indications of words in the form of synthesized sounds; and melody generator means for providing audible indications of melodies in the form of synthesized sounds, means responsive to said central processor means for fetching first data representing the sequence of sound synthesis of at least one word from said memory means and for providing said first data to said word generator means; and means responsive to said central processor means for fetching second data representing the sequence of sound synthesis of at least one melody from said memory means and for providing said second data to said melody generator means.

2. A synthesizer comprising:

central processor means for receiving word codes or melody program codes and for outputting signals controlling said synthesizer;

decision means for deciding whether said central processor means outputs signals indicating that it has received word codes or melody program codes;

memory means for storing data representing sequences of sound synthesis for each of a plurality of words and melodies which may be synthesized by said synthesizer;

word generator means for providing audible indications of words in the form of synthesized sounds; and melody generator means for providing audible indications of melodies in the form of synthesized sounds, said word generator means and said melody generator means being alternately and selectively responsive to output of said decision means;

means responsive to said decision means for fetching first data representing the sequence of sound synthesis of at least one word from said memory means and for providing said first data to said word generator means; and means responsive to said decision means for fetching second data representing the sequence of sound synthesis of at least one melody from said memory means and for providing said second data to said melody generator means.

3. A synthesizer as defined in claim 1 wherein said memory means stores pitch data and duration data for generation of melodies.

4. A synthesizer as defined in claim 3 wherein said melody generator means further includes an envelope memory for providing a proper envelope for the pitch data.

5. A synthesizer as defined in claim 1 wherein said word generator means and said melody generator means are independent of each other.

6. A synthesizer as in claim 2, wherein said word generator means and said melody generator means are independent of each other.

* * * * *